US006467735B1

(12) United States Patent
Clinton

(10) Patent No.: US 6,467,735 B1
(45) Date of Patent: Oct. 22, 2002

(54) DEVICE FOR SUPPORTING A FLEXIBLE BAG

(76) Inventor: Edward D. Clinton, 175 Deanna Rd., Brockton, MA (US) 02402

( * ) Notice: Subject to any disclaimer, the term of this patent is extended or adjusted under 35 U.S.C. 154(b) by 0 days.

(21) Appl. No.: 09/513,383

(22) Filed: Feb. 25, 2000

Related U.S. Application Data

(63) Continuation-in-part of application No. 09/190,807, filed on Nov. 12, 1998, now abandoned.

(51) Int. Cl.[7] ..... A63B 55/04
(52) U.S. Cl. ..... 248/97; 248/99; 248/153
(58) Field of Search ..... 248/97, 99, 153, 248/175; 141/391; 211/126.8

(56) References Cited

U.S. PATENT DOCUMENTS

| | | | | | |
|---|---|---|---|---|---|
| 228,733 | A | | 6/1880 | Curtis et al. | 248/98 |
| 967,368 | A | * | 8/1910 | Grigsby | |
| 1,052,392 | A | | 2/1913 | Ranken | 248/97 |
| 1,512,421 | A | | 10/1924 | Harrison | 248/99 |
| 2,917,260 | A | * | 12/1959 | Barber et al. | |
| 3,334,766 | A | * | 8/1967 | Rogus | 211/126.8 |
| 3,627,242 | A | | 12/1971 | Vandermast | 248/97 |
| 4,031,689 | A | * | 6/1977 | Sullivan | 248/97 |
| 4,157,801 | A | * | 6/1979 | Elmer | 248/97 |
| 4,957,252 | A | * | 9/1990 | Watkins | 248/97 |
| 5,826,837 | A | * | 10/1998 | Moineau et al. | 248/97 |

* cited by examiner

*Primary Examiner*—Korie Chan
(74) *Attorney, Agent, or Firm*—Pandiscio & Pandiscio; Scott R. Foster

(57) ABSTRACT

A device for supporting a flexible bag comprises a generally elliptically-shaped first loop of rigid wire-like material, the first loop being adapted for engagement with a support surface. Legs of the same material upstand from the first loop. A generally elliptically-shaped second loop of rigid wire-like material is fixed to upper ends of the legs which maintain the second loop spaced from the first loop, in a plane parallel with a plane of the first loop, and disposed centrally of the first loop in plan view. The legs incline from the first loop to the second loop and are operative to lock a bag on the device as the bag is filled. The first and second loops are each provided with straight side portions parallel to each other.

1 Claim, 3 Drawing Sheets

DEVICE FOR SUPPORTING A FLEXIBLE BAG

CROSS-REFERENCE TO RELATED APPLICATION

This application is a continuation-in-part of U.S. patent application Ser. No. 09/190,807, filed Nov. 12, 1998 now abandoned in the name of Edward D. Clinton.

BACKGROUND OF THE INVENTION

1. Field of the Invention

The invention relates to devices for holding flexible bags and is directed more particularly to a device for holding a sand bag while the bag is being filled with sand.

2. Description of the Prior Art

In flood control and in military defense situations, bags filled with sand and tied closed are used in large numbers. Such bags usually are filled essentially in situ in view of the relatively large volume and weight of filled bags, making transport of filled bags impracticable in most instances.

Filling a sand bag usually requires the attention of two people, one to hold the bag in an upright and open condition, and the other to shovel sand into the bag. Obviously, for each 1,000 people assigned to filling sand bags, only 500, or so, typically are actually filling, while the other 500 are holding. Further, the bag holders often are accidentally struck on the hands, head and face by the fillers whose accuracy diminishes as exhaustion approaches.

It is deemed beneficial, particularly when time is short, as in "flash" flood situations, to be able to devote a large majority of the assigned people to actually filling the bags, and to make the bag filling exercise as safe as possible.

Generally similar devices have been provided previously. For example, in U.S. Pat. No. 228,733, issued Jun. 15, 1890, in the names of H. M. Curtis, et al, there is shown a bag-holder having a bag-holding loop for retaining the open end of a bag. A circular lower loop is provided and disposed beneath the bag-holding loop. A single post is fixed to the lower loop and extends upwardly therefrom. The bag-holding loop is mounted on the post.

In U.S. Pat. No. 1,052,379, issued Feb. 4, 1913, in the names of J. F. Ranken, et al, there is shown a refuse bag assembly which includes upper and lower loops interconnected by legs extending therebetween. The upper loop supports a bag which hangs therefrom. The lower loop forms a base for the assembly. Both loops are circular in configuration.

In U.S. Pat. No. 1,512,421, issued Oct. 21, 1924, in the name of J. F. Harrison, there is shown a bag holder having a single loop for attachment to a wall. The single loop supports a bag which hangs therefrom.

In U.S. Pat. No. 3,627,242, issued Dec. 14, 1971, in the name of A. P. Vandermast, there is shown a bag holder having an upper circular loop and a lower circular loop. The two loops are mounted on legs. The lower loop is removably attached to the legs intermediate of the upper loop and lower free ends of the legs. A bag is hung from the upper loop. The lower loop locks the legs in position. Both loops are circular in configuration.

In the filling of sand bags, the shovellers typically are positioned on a sand pile, or adjacent thereto, within a shovel's reach. The holders, whether people or bag-holding devices, are typically in a circle around the sand pile and the shovellers. When devices of the types shown in the prior art, such as Curtis, Ranken and Vandermast, are used in conjunction with sand bags of the type readily available and currently used in large quantities, such devices provide benefits but also certain problems which must be contended with. As the bag is filled, and "balloons" out at the bottom, the top of the bag often is drawn downwardly through the upper loop, effectively stopping the filling operation until a person reattaches the open end of the bag to the device's upper loop. Further, the number of devices which can be placed in a circle around a pile of sand is limited by the diameter of the lower loop; that is, only so many circular loops can be placed side by side in a circle around the sand pile.

Accordingly, there is a need for a bag-holding device which is operative to lock the open end of the bag in place automatically as the bag is filled. There is further a need for a bag-holding device having a loop member serving as a base for the device and having a reduced width, so that more holders may occupy a given circle around a sand pile.

SUMMARY OF THE INVENTION

An object of the invention is, therefore, to provide a device for supporting a flexible bag in an upright and open condition for filling by a single operator.

A further object of the invention is to provide such devices as are operative to lock a bag in place on the device as the device is filled.

A still further object of the invention is to provide such a device provided with a lower loop adapted to serve as a base portion of the device and having a reduced widthwise dimension so as to permit positioning of larger numbers of the device in a circle.

With the above and other objects in view, as with hereinafter appear, a feature of the present invention is the provision of a device for supporting a flexible bag, the device comprising a generally elliptically-shaped first loop of rigid wire-like material, the first loop being adapted for engagement with a support surface, legs upstanding from the first loop and inclining inwardly, and a generally elliptically-shaped second loop of rigid wire-like material fixed to upper ends of the legs, which maintain the second loop spaced from the first loop, in a plane parallel with a plane of the first loop, and disposed centrally of the first loop in plan view. The first loop is provided with straight side portions parallel to each other, and the second loop is provided with straight side portions parallel to each other.

In accordance with a further feature of the invention, there is provided a device for supporting a flexible bag, the device comprising a generally elliptically-shaped first loop of rigid wire material, the first loop being provided with straight side portions parallel to each other and being adapted for engagement with a support surface, legs upstanding from the first loop, and a generally elliptically-shaped second loop of rigid wire material fixed to ends of the legs, the legs maintaining the second loop spaced from the first loop, in a plane substantially parallel with a plane of the first loop, and disposed substantially centrally of the first loop in plan view, the second loop being provided with straight side portions parallel to each other and to the first loop straight side portions, the legs inclining inwardly from the first loop to the second loop.

In accordance with a still further feature of the invention, there is provided a device for supporting a flexible bag, the device comprising a first loop of rigid wire material, the first loop forming a bottom base for the device and adapted for engagement with a support surface. The first loop is provided with straight first and second side portions parallel to each other and curved first and second end portions opposed to each other and each joining the first and second side portions. Legs are fixed at a lower end portion thereof to the first loop and are upstanding from the first loop. A second loop of rigid wire material is fixed to upper end portions of the legs, the legs maintaining the second loop spaced from the first loop, in a plane substantially parallel with a plane of the first loop, and disposed centrally of the first loop in plan view. The second loop forms a top member of the device and is adapted to support an open end of a flexible bag. The second loop is provided with first and second straight side portions parallel to each other and to the first loop first and second straight side portions, respectively, and provided with curved first and second end portions opposed to each other and each joining the second loop first and second side portions. The legs incline inwardly from the first loop to the second loop. The legs comprise first and third legs on the first end portions adjacent respective straight side portions of the first and second loops, and second and fourth legs on the second end portions adjacent respective straight side portions of the first and second loops. The first and second legs are closer together along the loops than the first and third legs and the second and fourth legs, and the third and fourth legs are closer together along the loops than the first and third legs and the second and fourth legs. The legs permit a sandbag mounted on the device with an open end thereof folded over the second loop and extending downwardly therefrom, and being filled with sand, to bulge outwardly at the end portions thereof while being restrained from bulging outwardly at the straight side portions, to cause an upper portion of the sandbag to be drawn inwardly onto the legs and the second loop, to lock the sandbag onto the device.

The above and other features of the invention, including various novel details of construction and combinations of parts, will now be more particularly described with reference to the accompanying drawings. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
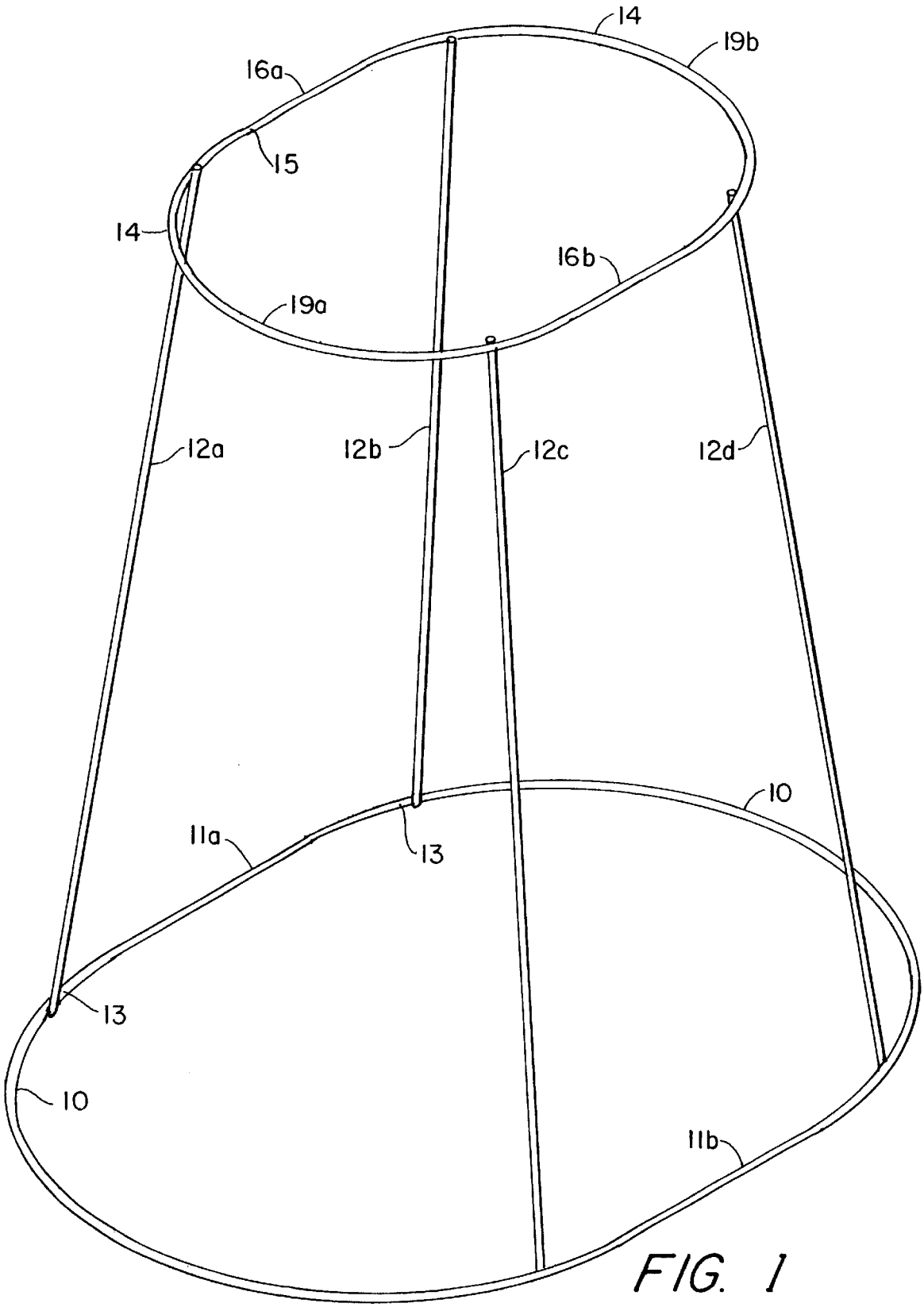
FIG. 1 is a perspective view of one form of device for supporting a sand bag, illustrative of an embodiment of the invention.

Referring to the drawings, it will be seen that the illustrative device includes a generally elliptically-shaped first loop 10 of rigid wire or wire-like material, preferably galvanized steel and preferably of 3/16 inch diameter round stock. The first loop 10 is provided with an end-to-end length A (FIG. 3) of about fourteen inches and a side-to-side length C of about ten to eleven inches. Side portions 11*a*, 11*b* of the first loop 10 are straight and parallel to each other. Curved first and second end portions 18*a*, 18*b* are opposed to each other and respectively join the first and second side portions 11*a*, 11*b*.

Legs 12*a*, 12*b*, 12*c*, and 12*d* extend from the first loop 10 and incline inwardly, preferably inclining at an angle of about 15–35° from vertical. The legs 12 preferably are of the same material as the first loop 10 and are welded to the first loop, preferably welded to the inside surface 13 of the first loop 10.

Figure 3:
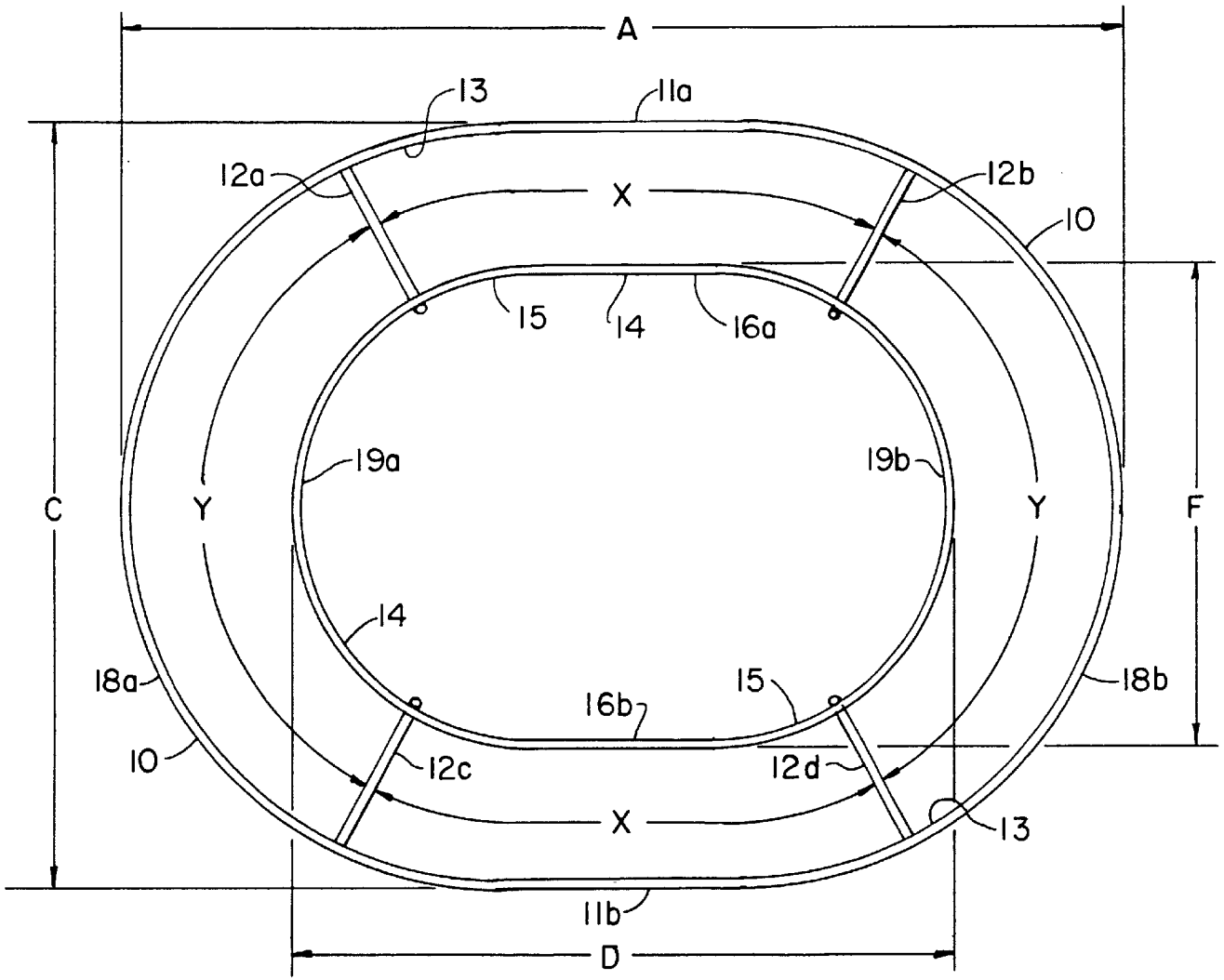
FIG. 3 is a top plan view of the device of FIG. 1.

A generally elliptically-shaped second loop 14 is fixed, as by welding, to ends of the legs 12 spaced from the first loop 10. Preferably, the legs 12 are welded to the second loop 14 at an inside surface 15 of the second loop 14. The legs 12 maintain the second loop 14 spaced from the first loop, in a plane substantially parallel to the plane of the first loop, and disposed substantially centrally of the first loop in plan view (FIG. 3). Preferably, the second loop 14 is of the same material as the first loop 10 and legs 12. The second loop 14 is provided with an end-to-end length D of about nine to ten inches and a side-to-side length F of about seven inches. Side portions 16*a*, 16*b* of the second loop 14 are straight and parallel to each other, and preferably parallel to the first loop side portions 11*a*, 11*b*. Curved first and second end portions 19*a*, 19*b* are opposed to each other and respectively join the first and second side portions 16*a*, 16*b* of the second loop 14.

The first and second legs 12*a*, 12*b* are closer together in a direction X (FIG. 3), generally along the loops, than the first and third legs 12*a*, 12*c*, and the second and fourth legs 12*b*,12*d*, in a direction Y. The third and fourth legs 12*c*, 12*d* are closer together in direction X, generally along the loops, than the first and third legs 12*a*, 12*c*, and the second and fourth legs 12*b*, 12*d* in direction Y, generally along the loops.

Figure 2:
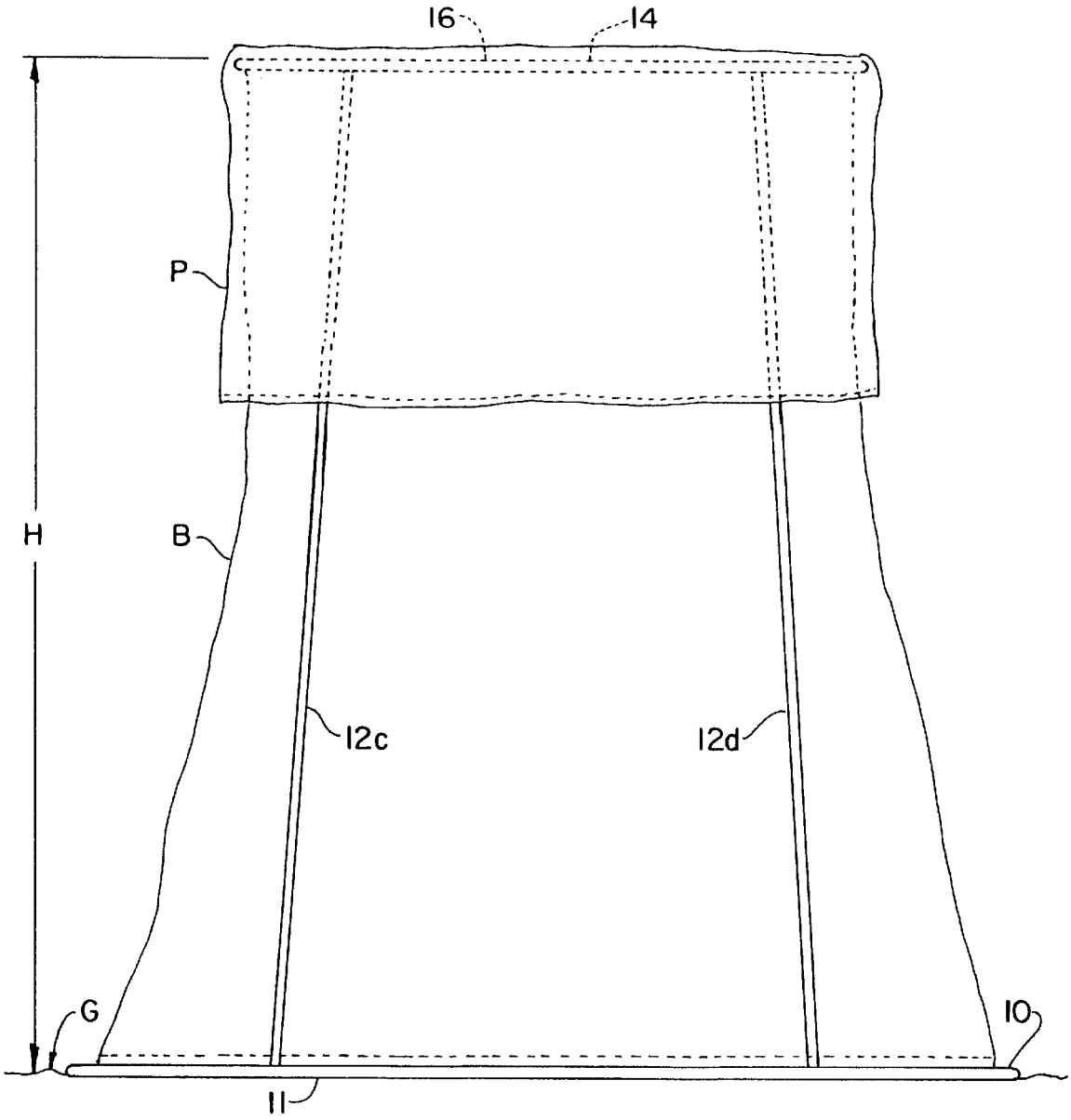
FIG. 2 is an elevational view of the device of FIG. 1 illustrated in use.

The device is of a height H less than the length of an empty flexible bag B (FIG. 2). Typically, "thirty pound" sand bags are about 26–27 inches in length and the height of the device is about 15½ inches. Thus, the upper portion P of the sand bag B can be folded over the second loop 14 to form a cuff, while the bottom of the sand bag B rests on the same support surface G as does the first loop 10, as shown in FIG. 2.

Larger bags, referred to as "fifty pound" sand bags, typically are of a length of about 33 inches and a width of about 16 inches. The inventive device for use in conjunction with such bags is correspondingly larger, to permit the bag to rest upon the same surface as the device with the upper end of the bag stretched over the second loop and downwardly by at least six inches. The device for use with the larger bags preferably is of ¼ inch diameter round stock.

The angled legs 12 permit nesting, or stacking, of the devices one on another, such that a large member of devices can be shipped or stored in a relatively compact manner. Inasmuch as the legs 12 are fixed to the inside surfaces 13, 15 of the loops 10, 14, the legs 12 ride along outside surfaces of the loops 10, 14, insuring that one device can be smoothly stacked upon and around another device.

In operation, a device is removed from a stack of like devices and set on the support surface, such as ground G in FIG. 2. The bag B is passed downwardly through the second loop 14 until the bottom of the bag engages and rests upon the support surface. The open end of the bag is then flared outwardly and stretched over the second loop 14 and back downwardly on the outside thereof at least about six inches.

The bag is then filled with sand, as by shoveling. Upon completion of the filling operation, the top of the bag is removed from the second loop 14 and tied closed. The device is then lifted from the sand bag and set aside, whereupon the sand bag may be moved as needed and the process begun again. The straight side portions 11 permit close side-by-side positioning of a plurality of the devices, such that a greater number of devices can be positioned side by side in a given circle around a pile of sand than is the case with circular based devices.

Upon filling the bag, the lower portion of the bag expands peripherally, but encounters the legs 12 which cause the bag to bulge outwardly at the end portions, between the legs 12*a* and 12*c* and between the legs 12*b* and 12*d*, while being restrained from bulging outwardly at the straight side portions, between legs 12*a* and 12*b* and between legs 12*c* and 12*d*, to cause an upper portion of the sandbag to be drawn inwardly along the sides 16*a*, 16*b* of the loop 14, onto the legs and the second loop, to lock the sandbag onto the device. As the end areas bulge outwardly the "cuff" P of the bag is bulged outwardly endwise and drawn inwardly sidewise to press against the legs, to "lock" the cuff to the upper portion of the device. After filling of the bag, the device is manually urged upwardly off the bag, easily overcoming the "lock" and allowing removal of the device from the bag.

The legs of the inventive device are arranged to take advantage of the fact that as the bag bulges outwardly in one location, it is drawn inwardly in another location, to provide a feature which fixes the bag in place during filling. As noted above, it is common for the bags to collapse when undergoing filling in prior art devices which, of course, interrupts the filling operation. Often, time is of the essence in sand bagging situations.

There is thus provided a device for supporting a flexible bag, such as a sand bag, in an upright and open condition for filling by a single operator, which device is capable of densely-packed arrangement side by side in a given circle and which provides a self-locking feature to prevent slippage of the bag out of the device during a filling operation.

While the invention has been described in the context of a sand bag filling operation, and while it is expected that the inventive device will find substantial utility in sand bagging operations, it will be clear to those skilled in the art that the invention is equally applicable to any bagging operation, such as leaf bagging, trash bagging, and the like.

It is to be understood that the present invention is by no means limited to the particular construction herein disclosed and/or shown in the drawings, but also comprises any modifications or equivalents within the scope of the claims.

What is claimed is:

1. A free-standing device for supporting a flexible sandbag, the device comprising:

a first loop of rigid wire material, said first loop forming a bottom base for the device and adapted for engagement with a support surface, said first loop being provided with straight first and second side portions parallel to each other, and curved first and second end portions opposed to each other and each joining said first loop first and second side portions;

legs fixed at a lower end portion thereof to said first loop and upstanding from said first loop; and a second loop of rigid wire material fixed to upper end portions of said legs, said legs maintaining said second loop spaced from said first loop, in a plane substantially parallel with a plane of said first loop, and disposed centrally of said first loop in plan view, said second loop forming a top member of the device and adapted to support an open end of a flexible sandbag, said second loop being provided with first and second straight side portions, respectively, and provided with curved first and second end portions opposed to each other and each joining said second loop first and second side portions;

said legs inclining inwardly from said first loop to said second loop;

wherein said legs comprise first and third legs disposed on said curved first end portions adjacent respective straight side portions of said first and second loops, and second and fourth legs disposed on said curved second end portions adjacent respective straight side portions of said first and second loops;

wherein said first and second legs are closer together along said first straight side portions of said loops than said first and third legs are along said first curved end portions and said second and fourth legs are along said second curved end portions, and said third and fourth legs are closer together along said second straight side portions of said loops than said first and third legs are along said first curved end portions and said second and fourth legs are along said second curved end portions; and wherein said legs permit said sandbag mounted on said device with an open end thereof folded over said second loop and extending downwardly therefrom, and being filled with sand, to bulge outwardly at said end portions while being restrained from bulging outwardly at said straight side portions, to cause an upper portion of the sandbag to be drawn inwardly onto the legs and the second loop, to lock the sandbag onto the device.

* * * * *